US005293689A

United States Patent [19]

Voll

[11] Patent Number: 5,293,689

[45] Date of Patent: Mar. 15, 1994

[54] METHOD AND APPARATUS FOR SHARPENING A CUTTING BLADE OF A ROTARY SHAVER

[76] Inventor: Rodger F. Voll, R.R. #4, Innisfail, Alberta, Canada, T0M 1A0

[21] Appl. No.: 992,024

[22] Filed: Dec. 17, 1992

[51] Int. Cl.[5] ..... B26B 19/38

[52] U.S. Cl. ..... 30/35

[58] Field of Search ..... 30/34, 35, 36, 38, 39, 30/43, 51, 138, 329; 51/158, 159; 132/289, 292

[56] References Cited

U.S. PATENT DOCUMENTS

| | | | |
|---|---|---|---|
| 2,716,278 | 8/1955 | Thompson | 30/35 |
| 2,953,851 | 9/1960 | Wheeler | 30/35 |
| 3,032,939 | 5/1962 | Anderson | 30/35 |
| 3,932,967 | 1/1976 | Hanes | 30/35 |

FOREIGN PATENT DOCUMENTS

| | | | |
|---|---|---|---|
| 909027 | 10/1962 | United Kingdom | 30/35 |

*Primary Examiner*—Richard K. Seidel
*Assistant Examiner*—Paul M. Heyrana, Sr.
*Attorney, Agent, or Firm*—Anthony R. Lambert

[57] ABSTRACT

A method of sharpening the blades of a rotary shaver having rotating discs with a plurality of cutting blades consisting of the following steps. Firstly, substitute a cup shaped sharpening head for a comb-like shaving head on a rotary shaver. The cup shaped sharpening head has a flat abrasive bottom in communication with cutting blades on the rotating disc. Secondly, activate the drive motor whereby the disc rotates rapidly rubbing the cutting blades against the abrasive bottom of the cup shaped sharpening head.

6 Claims, 3 Drawing Sheets

METHOD AND APPARATUS FOR SHARPENING A CUTTING BLADE OF A ROTARY SHAVER

The present invention relates to a method and apparatus for sharpening a cutting blade of a rotary shaver.

BACKGROUND OF THE INVENTION

There are existing apparatus which can be used to sharpen a cutting blade of a rotary shaver; such as, U.S. Pat. No. 2,953,851 which issued to Wheeler in 1960 and U.S. Pat. No. 3,932,967 which issued to Hanes in 1976. Both of these patents disclose abrasive annular rings which are intended for insertion between a disc form rotary cutting blade and a comb-like circular shaving head of a rotary shaver.

There are a number of disadvantages with using abrasive annular rings. One disadvantage is that the annular rings must be specially adapted for use with a particular model of rotary shaver. Another disadvantage is that the annular rings are relatively fragile and are prone to being torn or bent by a misaligned blade. A final disadvantage relates to difficulties in installation as the shaving head or the annular ring can be damaged when installing the annular rings in position within the shaving head.

SUMMARY OF THE INVENTION

What is required is an improved apparatus for sharpening the cutting blades of rotary shavers.

According to the present invention there is provided a method of sharpening the blades of a rotary shaver. Virtually all rotary shavers consist of a body that houses a drive motor which rotates at least one drive shaft. At least one disc is mounted for rotation on the at least one drive shaft. The disc has a plurality of cutting blades. A circular comb-like shaving head covers the cutting blade. A support bracket supports the shaving head. A cover plate with at least one circular opening overlies the comb-like shaving head. The method is comprised of the following steps. Firstly, substitute a cup shaped sharpening head for the comb-like shaving head on the electric shaver. The sharpening head is non-rotatably fixed to the body. The cup shaped sharpening head has a flat abrasive bottom in communication with the cutting blades. Secondly, activate the drive motor whereby the disc rotates rapidly rubbing the cutting blades against the abrasive bottom of the cup shaped sharpening head.

The novel concept is that of replacing a shaving head of a rotary shaver with a sharpening head. The instructions that come with a rotary shaver describe how to disassemble the rotary shaver for cleaning. When reassembling the rotary shaver a sharpening head is substituted for the shaving head. Preferably, the same means which is used to prevent the shaving head from rotating is similarly used to prevent the sharpening head from rotating.

According to another aspect of the invention there is provided an apparatus for sharpening a rotary shaver which is comprised of a cup shaped body having a flat bottom surface and peripheral side walls which extend upwardly from the bottom toward a top edge thereby defining an interior cavity adapted to receive one of the cutting blades of a rotary shaver. An abrasive is positioned on the bottom surface of the cup shaped body. Stop means prevent the cup shaped body from rotating when the disc of the rotary shaver is rotating rapidly within the interior cavity with the cutting blades rubbing against the abrasive bottom of the cup shaped body.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1A:
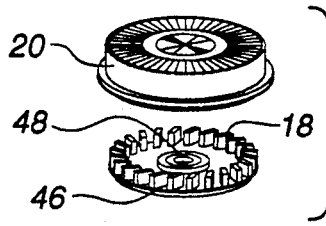
FIG. 1*a* through 1*d* are a series of perspective views of illustrating assembly of a rotary shaver labelled as "PRIOR ART".
Figure 1B:
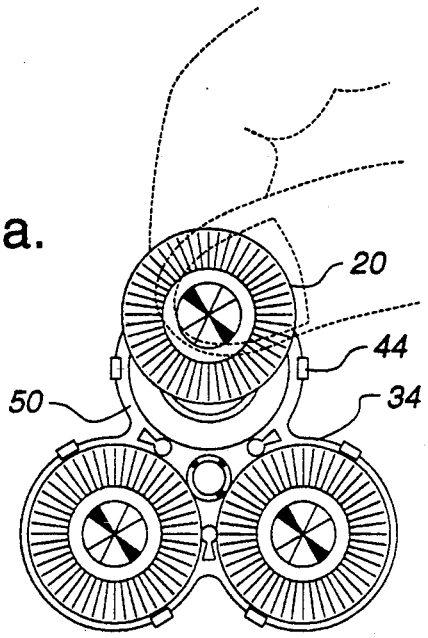
Figure 1C:
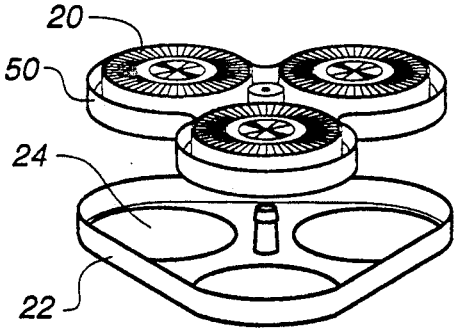
Figure 1D:
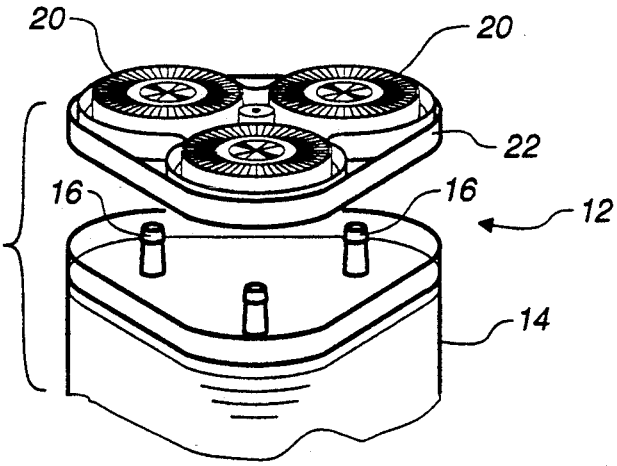

The present invention relates to a method and an apparatus. The preferred embodiment, an apparatus for sharpening the cutting blades of a rotary shaver generally identified by reference numeral 10, will now be described with reference to FIGS. 1 through 5. Apparatus 10 will hereinafter be referred to as sharpening head 10. Referring to FIGURES 1*a* through 1*d*, there is illustrated relevant components of a rotary shaver, generally identified by reference numeral 12. Rotary shaver 12 merely constitutes the working environment for sharpening head 10 and as such has been labelled as "PRIOR ART". Referring to FIG. 1*d*, rotary shaver 12 has a body 14 that houses a drive motor (not shown) which rotates a drive shaft 16. Referring to FIG. 1*a*, a disc 46 having a plurality of cutting blades 18 is mounted by means of a hub 48 for rotation on drive shaft 16. A circular comb-like shaving head 20 covers cutting blade 18. Referring to FIG. 1*b*, a support bracket assembly 34 which includes a support bracket 50 supports shaving head 20 and disc 46. Referring to FIG. 1*c*, a cover plate 22 with a circular opening 24 overlies support bracket 50 and shaving head 20.

The method will now be described with reference to FIGS. 5*a* through 5*d*. For the purpose of the following description of the method it is important to note that sharpening head 10 has a cup shaped body 26 and a flat abrasive bottom surface 28. The steps of the preferred method are as follow. Firstly, substitute cup shaped sharpening head 10 for shaving head 20 on rotary shaver 12. Sharpening head 10 must be non-rotatably fixed to body 14 of rotary shaver 12. Abrasive bottom surface 28 of sharpening head 10 must be in communication with cutting blades 18. The installation of sharpening head 10 in position is illustrated in FIGS. 5*a* through 5*d*, which may be contrasted with FIGS. 1*a* through Id showing recommended installation of shaving head 20 for which sharpening head 10 is being substituted. Secondly, activate drive motor (not shown) of rotary shaver 12 thereby causing disc 46 to rotate rapidly thereby rubbing cutting blades 18 against abrasive bottom surface 28 of cup shaped sharpening head 10. The abrasive contact with bottom surface 28 serves to sharpen cutting blades 18. The time duration of the contact need only be a matter of approximately five to ten seconds.

Figure 2:
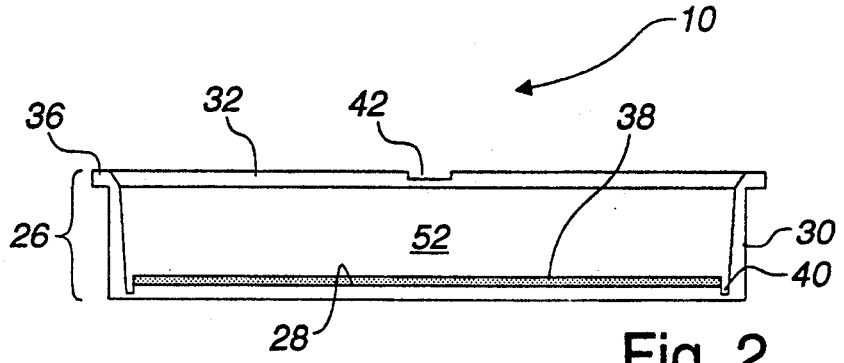
FIG. 2 is a longitudinal section view of an apparatus for sharpening a cutting blade of a rotary shaver constructed in accordance with the teachings of the present invention.
Figure 3:
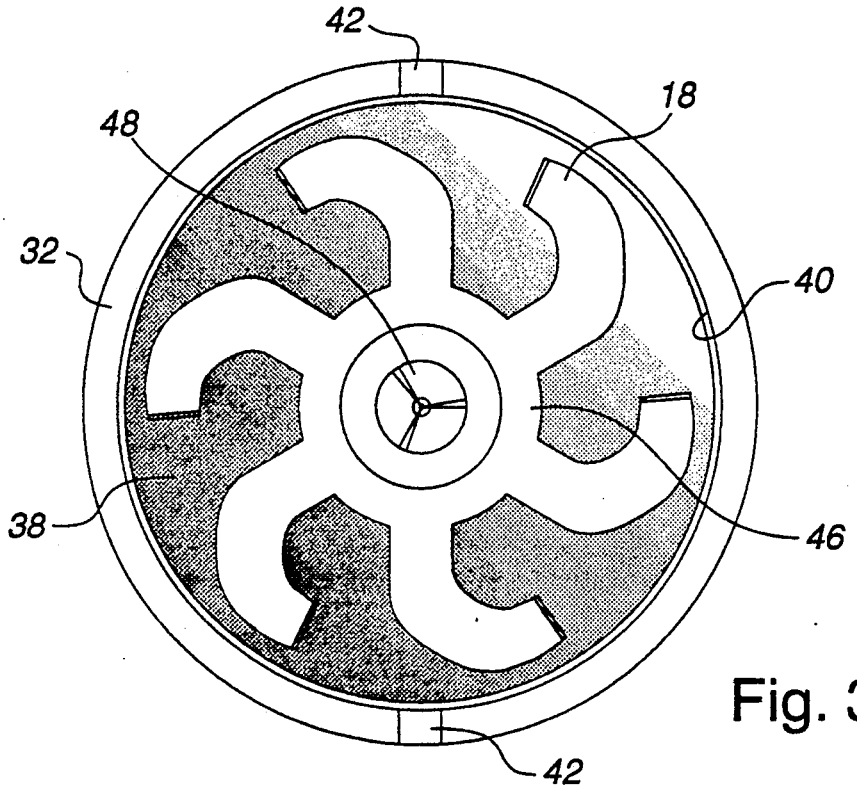
FIG. 3 is a top plan view of the apparatus illustrated in FIG. 2, with cutting blade.
Figure 4:
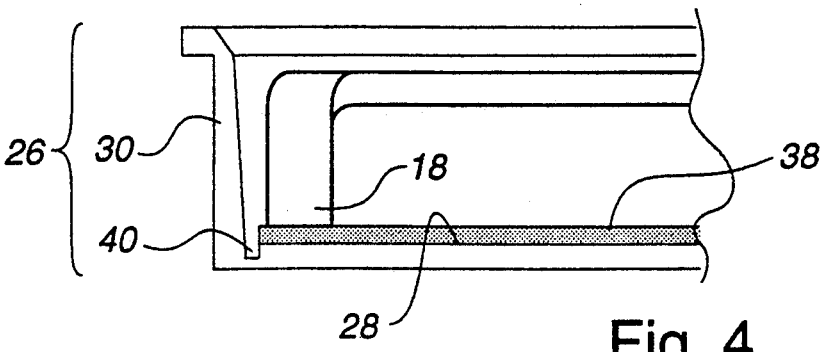
FIG. 4 is a longitudinal section view of the apparatus illustrated in FIG. 3.
Figure 5A:
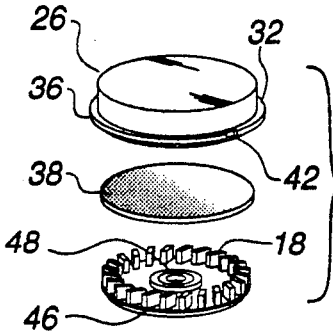
FIG. 5*a* through 5*d* are a series of perspective views illustrating assembly of the apparatus for sharpening a cutting blade shown in FIGS. 2, 3 and 4, into the rotary shaver illustrated in FIG. 1.
Figure 5B:
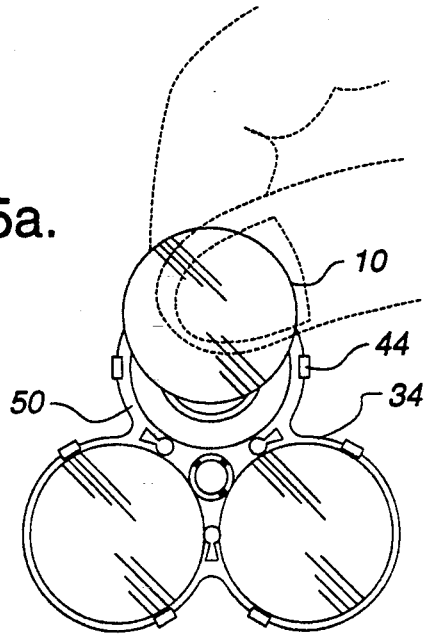
Figure 5C:
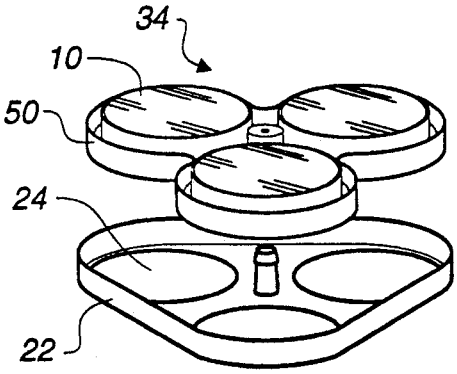
Figure 5D:
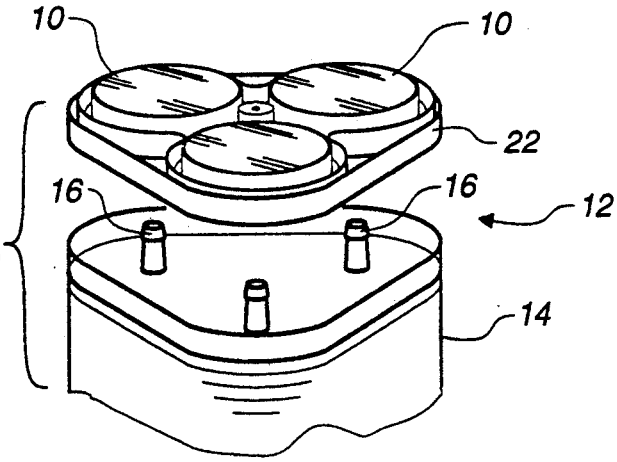

The form of sharpening head 10 may vary. FIGS. 2 through 4, illustrate the preferred embodiment. This preferred embodiment is moulded of polymer plastic. Referring to FIG. 2, cup shaped body 26 of sharpening head 10 has bottom surface 28 and peripheral side walls 30. Peripheral side walls 30 extend upwardly and are inclined outwardly from bottom surface 28 toward a top edge 32 thereby defining an interior cavity 52. Interior cavity 34 is adapted to receive disc 46 of rotary shaver 12. Top edge 32 has an outwardly projecting flange 36, the purpose of which will hereinafter be described. In accordance with the teachings of the method bottom surface 28 must be flat and covered with an abrasive. An abrasive disc 38, is therefore, positioned on bottom surface 28. With polymer plastic moulding processes there is sometimes a capillary action that raises the bottom surface adjacent the side walls. In order to ensure that the surface to which abrasive disc 38 adheres remains flat adjacent peripheral side walls 30, bottom surface 28 has an annular groove 40 adjacent side walls 30. Projecting flange 36 at top edge 32 of peripheral side walls 30 has two transverse grooves 42.

The functions of the described features of sharpening head 10 will now be described with reference to FIGS. 2 through 5. When apparatus 10 is installed in place of shaving head 20 in rotary shaver 12, as illustrated in FIGS. 5*a* through 5*d*, transverse grooves 42 on top edge 32 of peripheral side walls 30 mate with tongues 44 on rotary shaver 12. Transverse grooves 42 serve as stop means which prevent cup shaped body 26 from rotating when disc 46 is rotating rapidly rubbing cutting blades 18 against abrasive bottom 28 of cup shaped sharpening head 10. When apparatus 10 is installed in place of shaving head 20 in rotary shaver 12, flange 36 engages cover plate 22 adjacent circular opening 24. This prevents axial displacement of cup shaped body 26, thereby ensuring that contact is maintained between cutting blades 18 and abrasive disc 38 on bottom surface 28.

It will be apparent to one skilled in the art that modifications may be made to the illustrated embodiment without departing from the spirit and scope of the invention as defined by the claims.

The embodiments of the invention in which an exclusive property or privilege is claimed are defined as follows:

1. A method of sharpening the blades of a rotary shaver, having a body that houses a drive motor which rotates at least one drive shaft, at least one disc mounted for rotation on the at least one drive shaft, the disc having a plurality of cutting blades, a circular comb-like shaving head covering the disc, a support bracket supporting the shaving head and a cover plate with at least one circular opening which overlies the shaving head, comprising the steps of:

firstly, substituting a cup shaped sharpening head for the shaving head on the rotary shaver, the sharpening head being non-rotatably fixed to the body, the cup shaped sharpening head having a flat abrasive bottom in communication with cutting blade, secondly, activating the drive motor whereby the disc rotates rapidly rubbing the cutting blades against the abrasive bottom of the cup shaped sharpening head.

2. An apparatus for sharpening a rotary shaver, having a body that houses a drive motor which rotates at least one drive shaft, at least one disc mounted for rotation on the at least one drive shaft, the disc having a plurality of cutting blades, a circular slotted shaving head covering the disc, a support bracket supporting the shaving head and a cover plate with at least one circular opening which overlies the shaving head, said sharpening apparatus comprising:

a cup shaped body having a flat bottom surface and peripheral side walls which extend upwardly from the bottom surface toward a top edge thereby defining an interior cavity adapted to receive one of the discs of a rotary shaver;

an abrasive positioned on the bottom surface of the cup shaped body; and stop means to prevent the cup shaped body from rotating when the disc of the rotary shaver is rotating rapidly within the interior cavity with the cutting blades rubbing against the abrasive bottom of the cup shaped body.

3. The apparatus for sharpening a rotary shaver as defined in claim 2 wherein the peripheral side walls are inclined outwardly from the bottom surface to the top edge.

4. The apparatus for sharpening a rotary shaver as defined in claim 2 wherein the top edge has an outwardly projecting flange such that the flange engages the cover plate adjacent the circular opening when the cup shaped body is substituted for a shaving head in a rotary shaver.

5. The apparatus for sharpening a rotary shaver as defined in claim 2 wherein the stop means are transverse grooves on the top edge of the peripheral side walls which are adapted to mate with mating tongues on the rotary shaver, thereby preventing rotation of the cup shaped body.

6. An apparatus for sharpening a rotary shaver, having a body that houses a drive motor which rotates at least one drive shaft, at least one disc mounted for rotation on the at least one drive shaft, the disc having a plurality of cutting blades, a circular slotted shaving head covering the disc, a support bracket supporting the shaving head and a cover plate with at least one circular opening which overlies the shaving head, said sharpening apparatus comprising:

a cup shaped body having a flat bottom surface and peripheral side walls which extend upwardly and are inclined outwardly from the bottom surface toward a top edge thereby defining an interior cavity adapted to receive one of the discs of a rotary shaver;

the top edge having an outwardly projecting flange such that the flange engages the cover plate adjacent the circular opening when the cup shaped body is substituted for a shaving head in a rotary shaver thereby preventing axial displacement of the cup shaped body;

an abrasive positioned on the bottom surface of the cup shaped body; and stop means positioned on the top edge of the peripheral side walls to prevent the cup shaped body from rotating when the disc of the rotary shaver is rotating rapidly within the interior cavity with the cutting blades rubbing against the abrasive bottom of the cup shaped body, the stop means being transverse grooves on the top edge of the peripheral side walls which are adapted to mate with mating tongues on the rotary shaver.

* * * * *